US008621898B2

(12) United States Patent
Chen

(10) Patent No.: US 8,621,898 B2
(45) Date of Patent: Jan. 7, 2014

(54) FOLDABLE LOCK

(75) Inventor: Mao-Yi Chen, Jiangsu (CN)

(73) Assignee: Sinoxlock (Kunshan) Co., Ltd., Jiangsu (CN)

( * ) Notice: Subject to any disclaimer, the term of this patent is extended or adjusted under 35 U.S.C. 154(b) by 0 days.

(21) Appl. No.: 13/165,530

(22) Filed: Jun. 21, 2011

(65) Prior Publication Data

US 2011/0308282 A1 Dec. 22, 2011

Related U.S. Application Data

(60) Provisional application No. 61/357,313, filed on Jun. 22, 2010.

(51) Int. Cl.
*E05B 73/00* (2006.01)

(52) U.S. Cl.
USPC ..... 70/18; 70/49; 70/53

(58) Field of Classification Search
USPC ..... 70/14, 18, 22, 24, 30, 38 C, 49, 53
See application file for complete search history.

(56) References Cited

U.S. PATENT DOCUMENTS

| | | | | |
|---|---|---|---|---|
| 3,747,376 | A * | 7/1973 | White, Jr. | 70/18 |
| 3,748,876 | A * | 7/1973 | Mathews | 70/18 |
| 3,908,414 | A * | 9/1975 | Thorne | 70/18 |
| 4,760,718 | A * | 8/1988 | Muramatsu et al. | 70/18 |
| 5,475,993 | A * | 12/1995 | Kuo | 70/18 |
| 5,487,285 | A * | 1/1996 | Leichel et al. | 70/18 |
| 5,732,577 | A * | 3/1998 | Okada et al. | 70/18 |
| 5,913,906 | A * | 6/1999 | Strocchi | 70/18 |
| 6,820,448 | B1 * | 11/2004 | Hsieh | 70/18 |
| 7,437,898 | B2 * | 10/2008 | Su | 70/14 |
| D579,756 | S * | 11/2008 | Hentschel et al. | D8/331 |
| 7,481,084 | B1 * | 1/2009 | Wu | 70/18 |
| 7,712,339 | B2 * | 5/2010 | Hentschel et al. | 70/18 |
| 8,156,772 | B2 * | 4/2012 | Buhl et al. | 70/49 |

FOREIGN PATENT DOCUMENTS

| | | | |
|---|---|---|---|
| DE | 102 15 532 | A1 | 10/2003 |
| DE | 102 49 222 | A1 | 5/2004 |
| DE | 10 2005 040 066 | A1 | 3/2007 |
| DE | 102 15 534 | B4 | 11/2007 |
| DE | 20 2005 021 411 | U1 | 2/2008 |
| DE | 10 2007 035 116 | A1 | 1/2009 |
| DE | 10 2005 040 066 | B4 | 6/2009 |
| DE | 20 2005 021 748 | U1 | 12/2009 |
| EP | 1 413 699 | A1 | 4/2004 |
| EP | 2 019 178 | A2 | 1/2009 |

* cited by examiner

*Primary Examiner* — Christopher Boswell
(74) *Attorney, Agent, or Firm* — Birch, Stewart, Kolasch & Birch, LLP

(57) ABSTRACT

A foldable lock includes a first body, a second body, and a rod set including a plurality of pivotally connected locking rods. The first body and the second body are separately pin-connected to a locking rod. The first body, the second body, and the plurality of the locking rods can have rotational movement in two-dimensional space with the pin joint as a rotation axis, which affects relative position of the first body and the second body. The first body has a first mating face, and the second body has a second mating face. The mating faces can separate from or mate with each other. The bodies and the rod set constitutes a closed ring by means of matching of the mating faces; at this time, a locking operation will let the mating faces be unable to separate from each other, namely the bodies will not move relatively. At the same time, if the closed ring does not circle any object, the rod set can further be rotated to a stacking state for storage.

13 Claims, 9 Drawing Sheets

FOLDABLE LOCK

CROSS REFERENCE TO RELATED APPLICATIONS

This non-provisional application claims the benefit of U.S. Provisional Application No. 61/357,313 filed on Jun. 22, 2010. The entire contents of the above application is hereby incorporated by reference into the present application.

BACKGROUND OF THE INVENTION

1. Field of the Invention

The present invention generally relates to a lock apparatus. Particularly, the present invention relates to a foldable lock having a foldable rod set for storage.

2. Description of the Prior Art

As diversity of lifestyle and improvements in technology increases, the function and form of lock apparatuses also varies to meet the different requirements. Besides, because of widespread use of vehicles and related movable devices, lock apparatuses for outdoor movable devices were developed.

The way of securing bicycles, motorcycles, or other movable objects usually includes securing them to an immobile article, such as a pillar or other fixed facilities. Therefore, excluding the lock body, a lock apparatus for the purpose mentioned above usually has a cable for circling the fixed facilities and the object to be secured. For example, cable locks and chain locks were developed for this purpose. However, cable locks require rolling-up for storage while chain locks are not convenient for storage.

Recently, a foldable lock having a plurality of pin-connected locking rods for circling is provided. As FIG. 1 shows, the locking rods 51 are usually flat-shaped. In addition to being able to expand to circle an object, the locking rods 51 can also be rotated to a stacking state and form a block having a regular shape for storage in a box or a bag. However, the connection of the rod set 5 with the body 1 is usually through means of aiming and positioning the locking rod 51, which has a locking end 53, at a trough 12 of a body 1 so that a locking bolt 13 can be therefore fastened by a locking hole 532 of the locking end 53 in order to accomplish a locking operation. However, a slit 533 in the locking end 53 for the locking bolt 13 to pass through and rest at the trough 12 is too small for operation, and therefore improvements are needed.

SUMMARY OF THE INVENTION

It is an object of the present invention to provide a foldable lock capable of forming a closed ring to secure an object to an immobile article.

It is another object of the present invention to provide a foldable lock capable of forming a closed ring by means of matching two complementary mating faces of two bodies.

It is another object of the present invention to provide a foldable lock capable of being unfolded and expanded when used, and to be folded to form a block having a regular volume when in storage.

The foldable lock of the present invention includes a first body, a second body, and a rod set. The first body has a first mating face, the second body has a second mating face, wherein the two bodies can be separated from each other or be conjugated by matching the mating faces. The rod set is composed of a plurality of pin-connected locking rods. In addition, the first body and the second body are respectively pin-connected to the locking rods at the ends of the rod set.

Each locking rod can have rotational movement in two-dimensional space with the pin joint as the rotation axis. This rotational movement allows the first body and the second body to separate from or conjugate with each other. When the bodies are completely conjugated with each other, the bodies constitute a closed ring together with the rod set. If the closed ring does not encircle any object, the rod set can further be rotated to a stacking state and form a block configuration having a regular shape.

The first body has a protruding rotatable fastener and a guiding protrusion on the first mating face. The rotatable fastener is a part of a lock body and rotatably driven by the operation of the lock body. In comparison to the rotatable fastener and the guiding protrusion, a containing trough and a guiding groove are formed on the second mating face. The guiding groove of the second mating face and the guiding protrusion of the first mating face guide the rotatable fastener to enter the containing trough so that the rotatable fastener is rotatable in the containing trough in response to locking/unlocking operations.

The dimensional size of the first body and the second body suitably fits in a user's palm while the guiding components of the bodies are easy to understand and operate. Therefore during operation, the left palm and the right palm may respectively hold the first and second bodies, moving them toward each other. The movement can be operated in coordination with the guide of the guiding components to achieve conjugation of the bodies, wherein the rotatable bodies further shorten the time which is needed to orient and conjugate the bodies.

DETAILED DESCRIPTION OF THE PREFERRED EMBODIMENT

Figure 1:
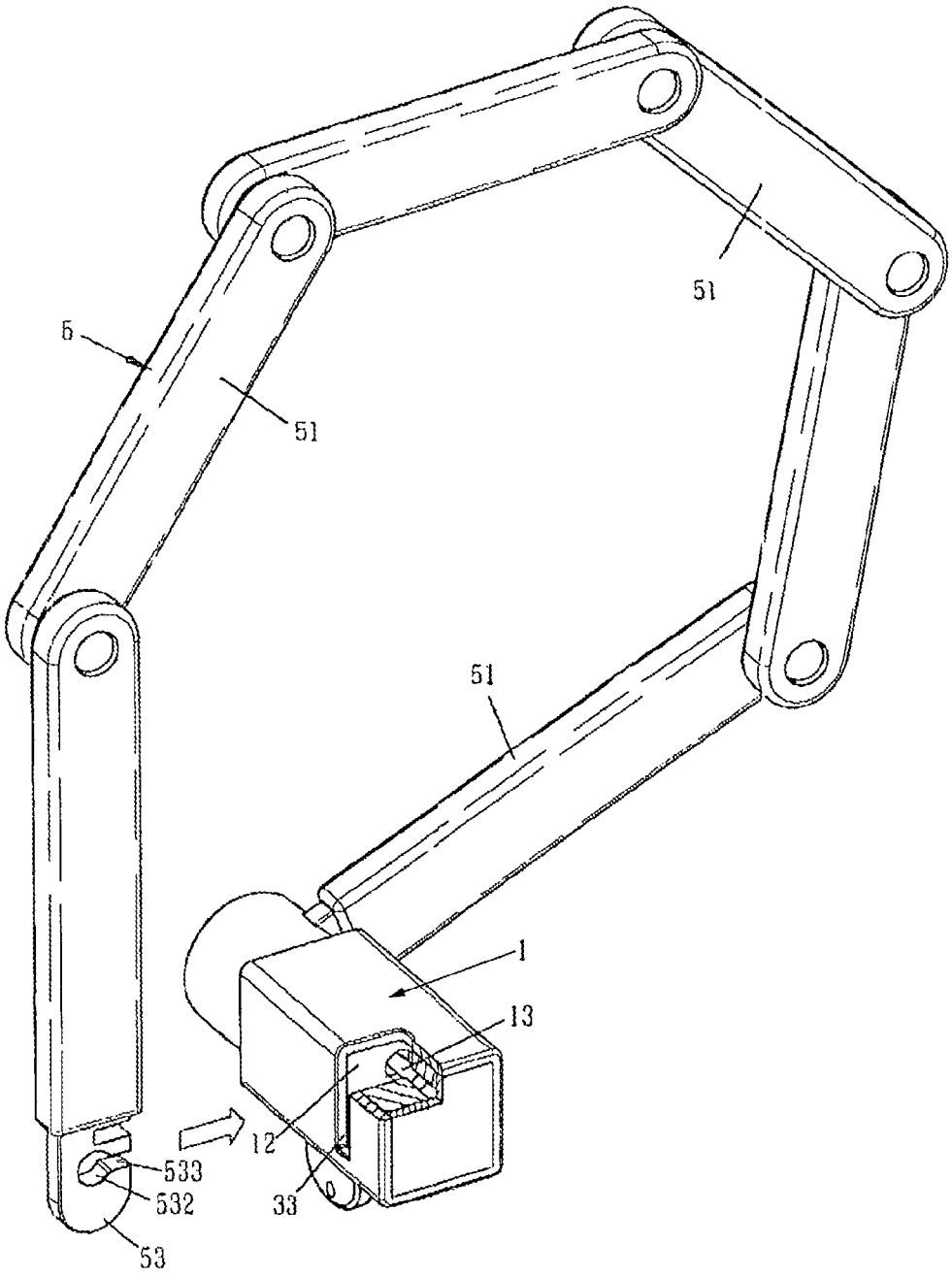
FIG. 1 (PRIOR ART)
FIG. 1 shows a schematic view of the conventional foldable lock.
Figure 2A:
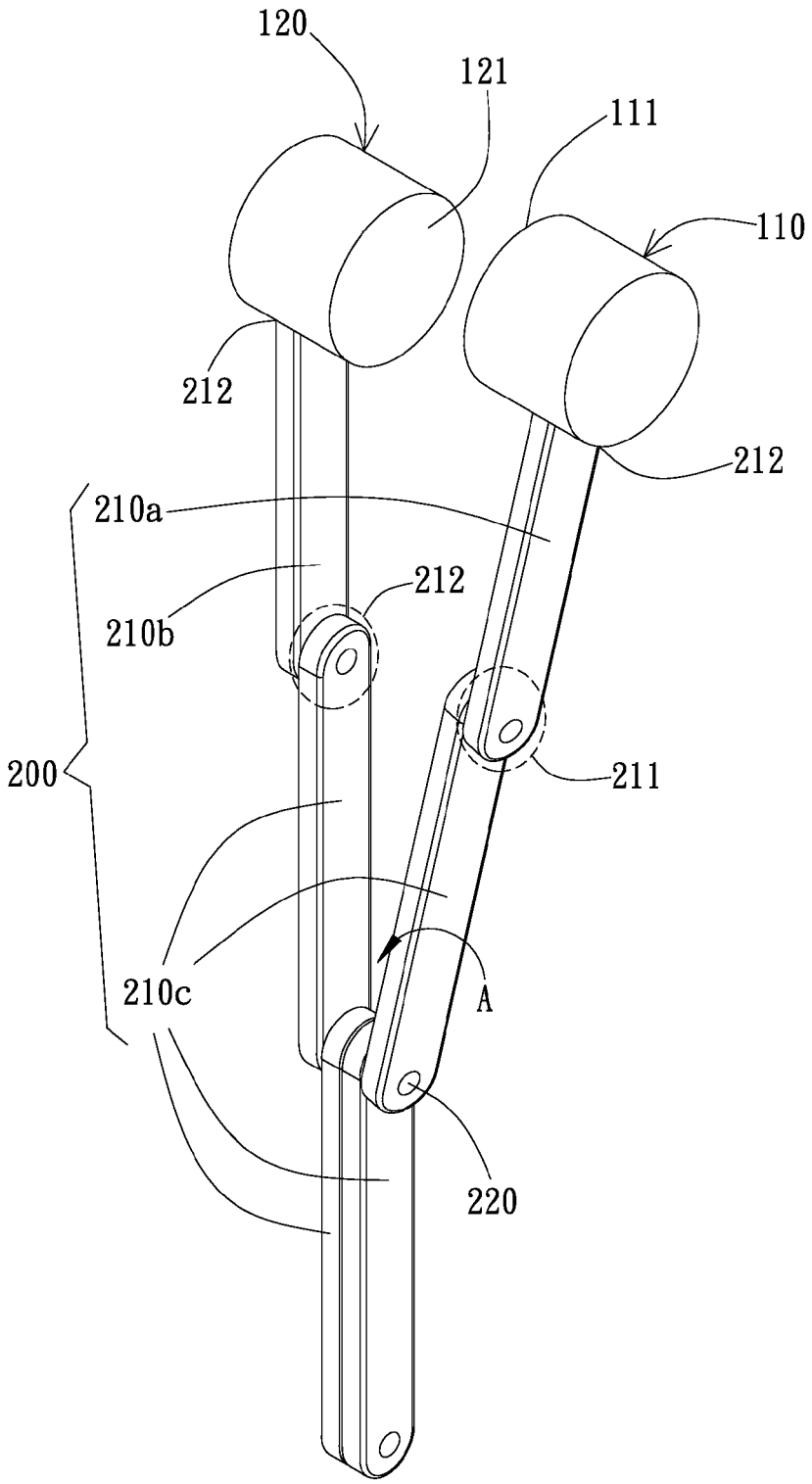
FIGS. 2A-2B are perspective views of the embodiment of the foldable lock of the present invention.
Figure 2B:
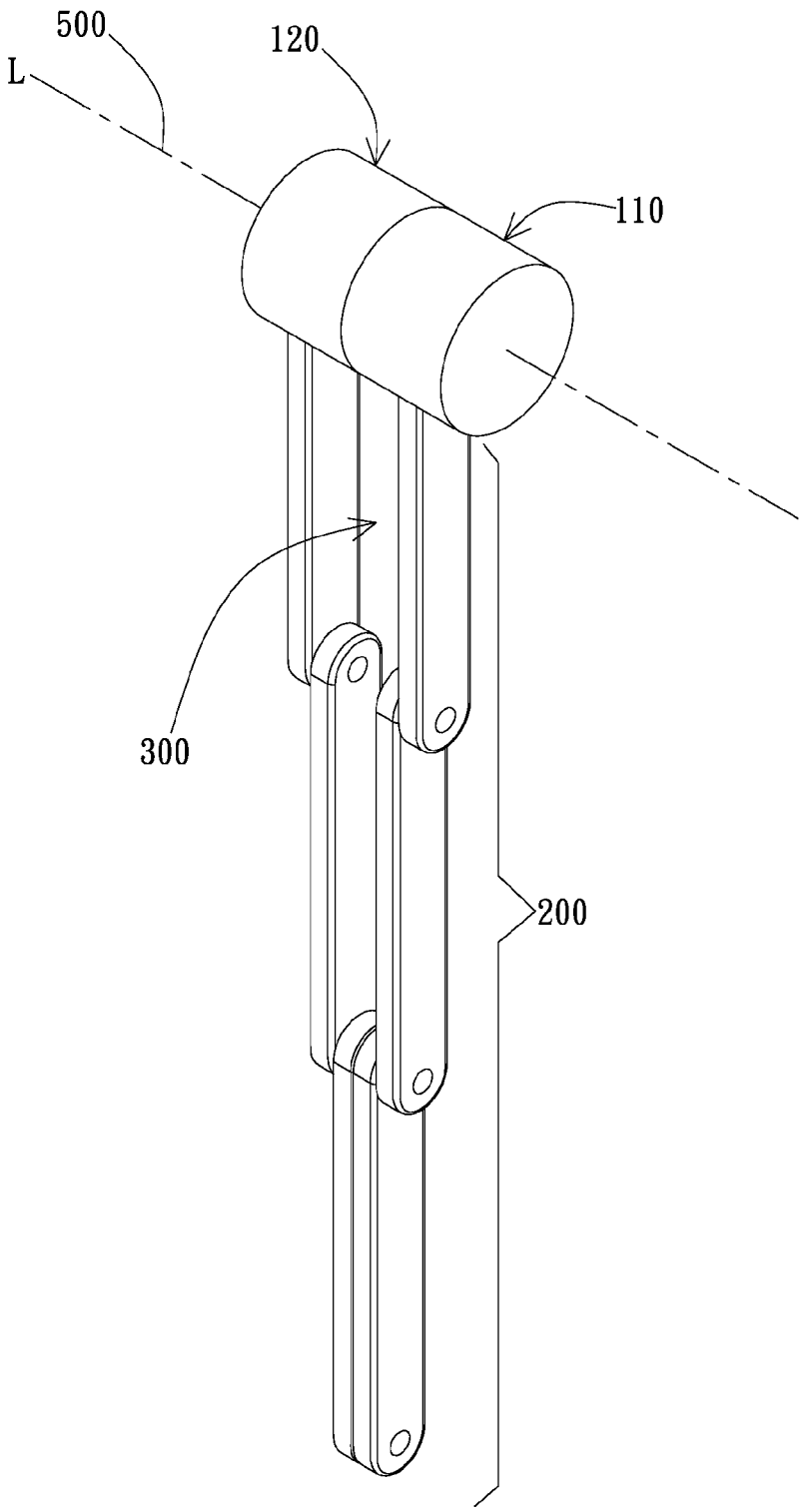

The present invention provides a foldable lock. FIGS. 2A-2B are perspective views of an embodiment of the present invention. As FIG. 2A shows, the foldable lock includes a first body 110, a second body 120, and a rod set 200 composed of a plurality of locking rods 210, wherein the first body 110 has a first mating face 111 and may include therein or be itself a lock body. The second body 120 has a second mating face 121, wherein the planes in which the mating faces rests are mutually overlapping or are parallel to each other. Moreover, the arrangement of the locking rods 210 is shown in FIG. 2A. The plurality of locking rods 210 are pivotally connected in series and connected to the first body 110 and the second body 120 at two ends of the rod set 200, wherein each locking rod 210 is rotatable in two-dimension space with a connection joint as a rotation axis. As shown in FIG. 2A, the locking rod 210 is usually flat-shaped and at least one end of each locking rod 210 includes a first end 211 and a second end 212, wherein every locking rod is connected to, especially pin-connected to the second end 212 or the first end 211 of the adjacent locking rod by the first end 211, which constitutes a connection, especially a pin joint 220. Each locking rod 210 with the pin joint 220 as the rotation axis can have rotational movement A. The rotational movement is in two-dimensional space. Namely, the planes on which the locking rods 210 are resting are parallel to each other. In addition, the locking rods further include a first locking rod 210*a* and a second locking rod 210*b* at the ends of the rod set 200, and are respectively connected with the first body 110 and the second body 120 by the second end 212. The rotation of the first locking rod 210*a* or the second locking rod 210*b* can therefore directly drive the movement of the first body 110 or the second body 120.

In addition to driving the movement of the first body 110 and the second body 120 through the first locking rod 210*a* and the second locking rod 210*b*, the rotation of at least one third locking rods 210*c* may also cause movement in the first body 110 and the second body 120 so that they change their relative positions. As FIG. 2B shows, through the rotating of the plurality of the locking rods 210 of the rod set 200, the first body 110 and the second body 120 will be positioned in alignment along a line 500. Meanwhile, the first mating face 111 and the second mating face 121 are opposite to and come in contact with each other. As a result, the first body 110 and the second body 120 conjugate with each other. The conjugated lock bodies and the rod set 200 form a closed ring 300.

Figure 3:
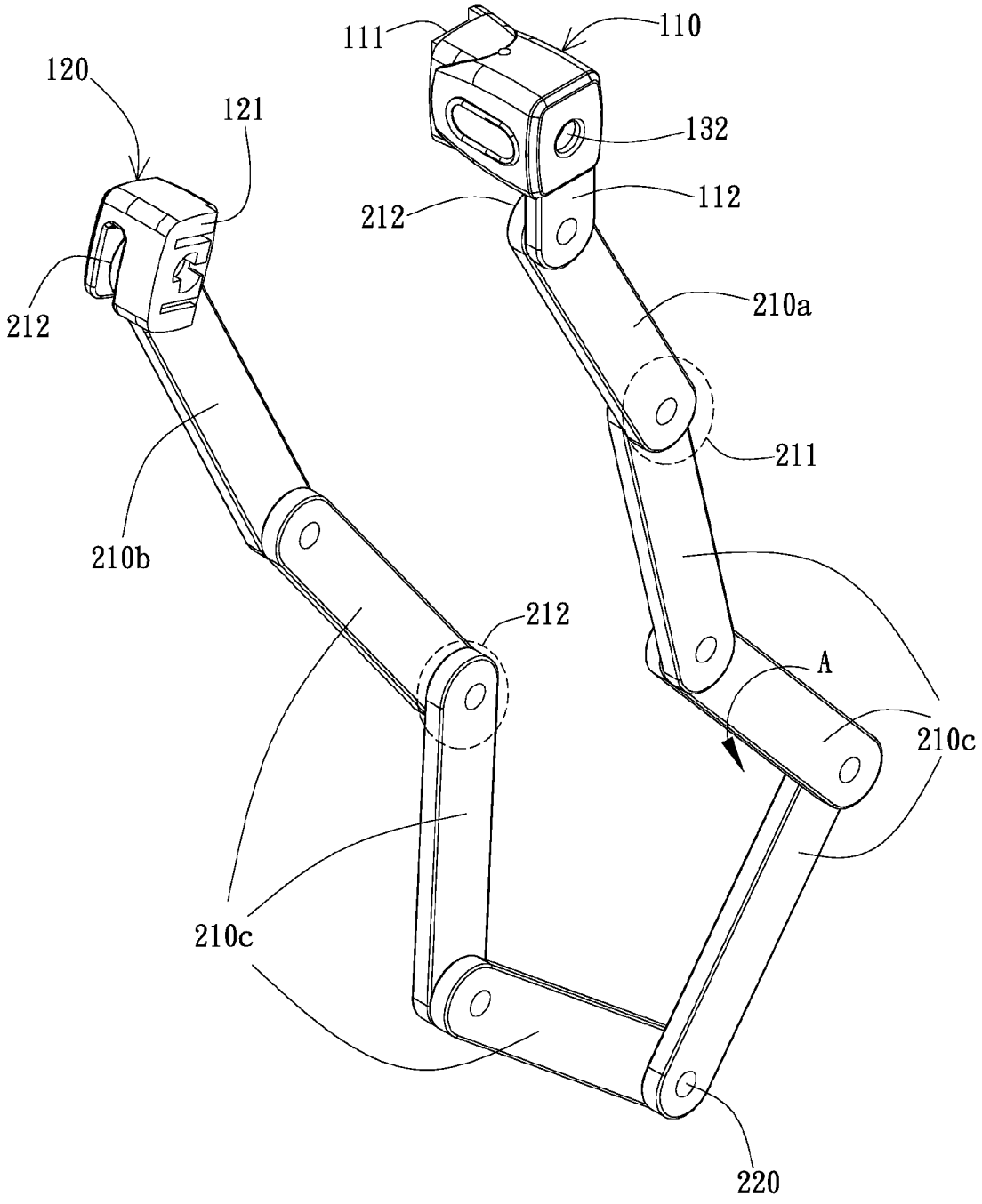
FIG. 3 is a perspective view of the embodiment of the foldable lock of the present invention.

FIG. 3 shows the preferred embodiment of the present invention mentioned above, wherein the first body 110 and the second body 120 respectively has the first mating face 111 and the second mating face 121. The first body 110 has the lock body disposed therein. In addition, the first mating face 111 further has a protrusion portion (described later), and the second mating face 121 has a cavern portion (described later). The outlines of the protrusion portion and the cavern portion are complementary to each other. In the preferred embodiment of the present invention, the rod set 200 includes eight locking rods 210, wherein seven locking rods have the same length and the remaining rod has a length that is longer than the other seven rods. Each locking rod has the first end 211 and the second end 212, whereon a round hole is formed for the connecting components, such as a rivet or screw, to connect to adjacent locking rods and other adjacent components. The third locking rod 210*c* is pin-connected by its first end 211 to the second end 212 or the first end 211 of the adjacent locking rod, and/or by its second end 212 to the first end 211 of the adjacent locking rod. The first locking rod 210*a* and the second locking rod 210*b* are respectively pin-connected to the first body 110 and the second body 120 by the second end 212, wherein the pin joint of the first locking rod 210*a* and the first body 110 is located at a connection portion 112 disposed outside the first body 110. The connection joint of the second locking rod 210*b* and the second body 120 is located inside the second body 120, and therefore the second locking rod 210*b* is preferably longer. Each locking rod 210 and the body can have rotational movement A in two-dimensional space, with their pin joints as the rotation axes, and therefore drive the bodies to conjugate.

Figure 4A:
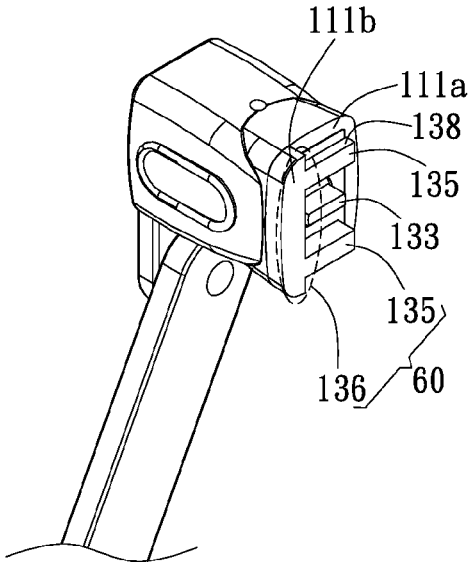
FIG. 4A is a perspective view of the first body of the embodiment of the foldable lock.
Figure 4B:
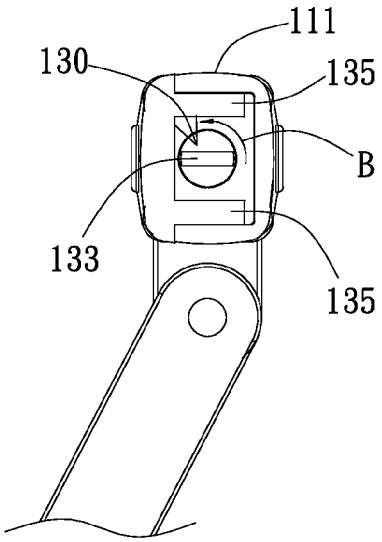
FIG. 4B is a schematic view of the first mating face of the embodiment of the foldable lock.

As mentioned above, the first mating face 111 has a protrusion portion 60, wherein the preferred embodiment is shown in FIG. 4A. As the figure shows, the first mating face 111 of the first body 110 has a protrusion portion 60. The protrusion portion 60 includes a guiding protrusion 135 and a blocking portion 136 that is connected to the guiding protrusion 135. A surface of the guiding protrusion 135 and a surface of the blocking portion 136 facing toward the second mating face 121 are on the same plane and connected with each other to form the first mating face 111*b*. In the embodiment of the present invention, the number of guiding protrusions 135 may be but not limited to two. As the FIG. 4B shows, two congruent guiding protrusion 135 can be seen in a front side view of the first mating face 111.

In addition, the first mating faces 111*a* and 111*b* of the protrusion portion 60 (including the guiding protrusion 135 and the blocking portion 136) are parallel to each other. The guiding protrusion 135 and the blocking portion 136 have a side surface 138 which is simultaneously perpendicular to both the first mating faces 111*a* and 111*b*. The protrusion portion 60 of the first mating face 111 enables the first mating face 111 to complement and match the second mating face 121 (described later).

Figure 4C:
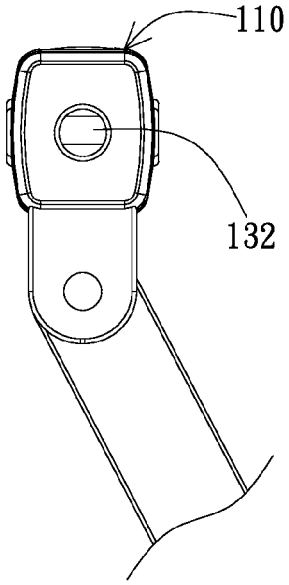
FIG. 4C shows a rear view of the first body of the embodiment of the foldable lock.

The function of the guiding protrusion 135 mentioned above, in conjunction with a guiding groove of the second mating face 121, is to guide the mating of the two mating faces. The mating of the two mating faces 111, 121 makes the rotatable fastener 133 enter a containing trough (described later). As FIGS. 4A-4B show, the rotatable fastener 133 is exposed from the first mating surface 111 and is disposed between the guiding protrusions 135. In this embodiment, the rotatable fastener 133 is a component belonging to or coupled with an end of the lock body thereon and protrudes out of a containing hole 130 where the lock body is disposed. The other end of the lock body has a key hole. As shown in the embodiment in FIGS. 3 and 4C, the key hole 132 is positioned at the rear side of the first body 110, which is contrary to the first mating face 111. When a key is inserted into the key hole 132, it is able to rotate the key, if the lock body is a key lock, to drive the rotatable fastener 133 to rotate as well. As FIG. 4B shows, when the inserted key is rotating, the rotatable fastener 133 rotates in a counterclockwise direction B when viewed from the front side of the first mating face 111, wherein the preferred greatest rotation angle is 90 degrees. In summary, after the guiding protrusion 135 and the guiding groove together guide the mating faces to match and to position the rotatable fastener 133 in the containing trough, a rotation of the inserted key will make the rotatable fastener 133 rotate in the containing trough (described later) and accomplish the locking operation, which allows the first body 110 and the second body 120 to conjugate. In other embodiments, the key lock can be replaced by a combination lock.

Figure 5A:
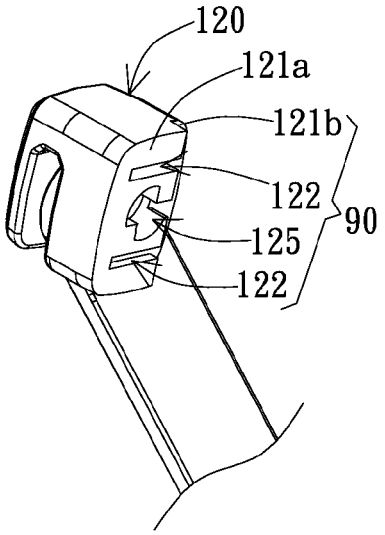
FIG. 5A is a perspective view of the second body of the embodiment of the foldable lock.
Figure 5B:
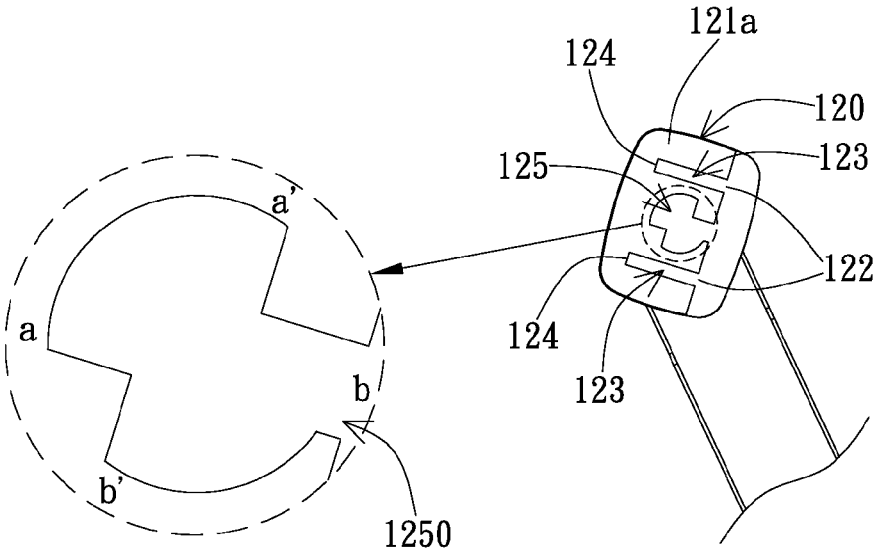
FIG. 5B is a schematic view of the second mating face of the embodiment of the foldable lock.

As FIGS. 5A-5B show, in comparison to the protrusion portion 60 of the first mating face 111 of the first body 110, the second mating face 121 of the second body 120 has the complementary cavern portion 90 that includes a guiding groove 122 formed on a second mating face 121*a*, a containing trough 125, and a second mating face 121*b*, wherein the guiding groove 122 corresponds to the guiding protrusion 135 and has a number of two. The guiding groove 122, in conjunction with the guiding protrusion 135, can guide the mating faces 111, 121 to match and to position the rotatable fastener 133 within the containing trough 125. The cavern portion 90 has an indentation having the second mating face

121*b* and a side surface. The side surface is perpendicular to both the second mating face 121*b* and 121*a*, and the second mating surface 121*b* together with the side surface is complementary to the blocking portion 136. Furthermore, the design of the containing trough 125 is in concert with accommodation and rotation of the rotatable fastener 133.

As the mentioned above, the guiding groove 122 and the guiding protrusion 135 guide the mating faces 111, 121 to match with each other by allowing the guiding protrusion 135 to enter the complementary guiding groove 122, wherein the guiding groove 122 has an open end 123 and a closed end 124 as shown in FIG. 5B. The open end 123 is positioned at the edge of the second mating face 121*a*, and the closed end is positioned within the second mating face 121*a*. The guiding protrusion 135 enters the guiding groove 122 through the open end 123 to a degree that the end of the guiding protrusion 135 entering the guiding groove 122 first reaches the closed end 124. Furthermore, the design of the containing trough 125 is in concert with accommodation and rotation of the rotatable fastener 133 therein. As shown in the dotted-line circle figure of the enlarged containing trough 125, a position b is at an opening 1250 of the containing trough 125. The opening 1250 allows the rotatable fastener 133 to enter the containing trough 125 as the first mating surface 111 mates with the second mating surface 121. A distance between positions a and b is equal to a distance between positions a' and b', wherein a line connecting position a and position b is perpendicular to a line connecting position a' and position b'. A route from positions a to a' is an arc portion in concert with rotation of the rotatable fastener 133. By means of guiding the guiding components (135 and 122), the fastener rotatable 133 will enter the containing trough 125 from position b and occupy the space having a length equal to the distance between the positions a and b. When the rotatable fastener 133 rotates, the end of the rotatable fastener 133 that enters the containing trough first will move from position a to position a' along the route of the arc portion while the other end moves from position b to position b' along the route of the other arc portion. Therefore, after rotating 90 degrees, the rotatable fastener 133 will occupy the space having a length equal to the distance between positions a' and b'.

Figure 6:
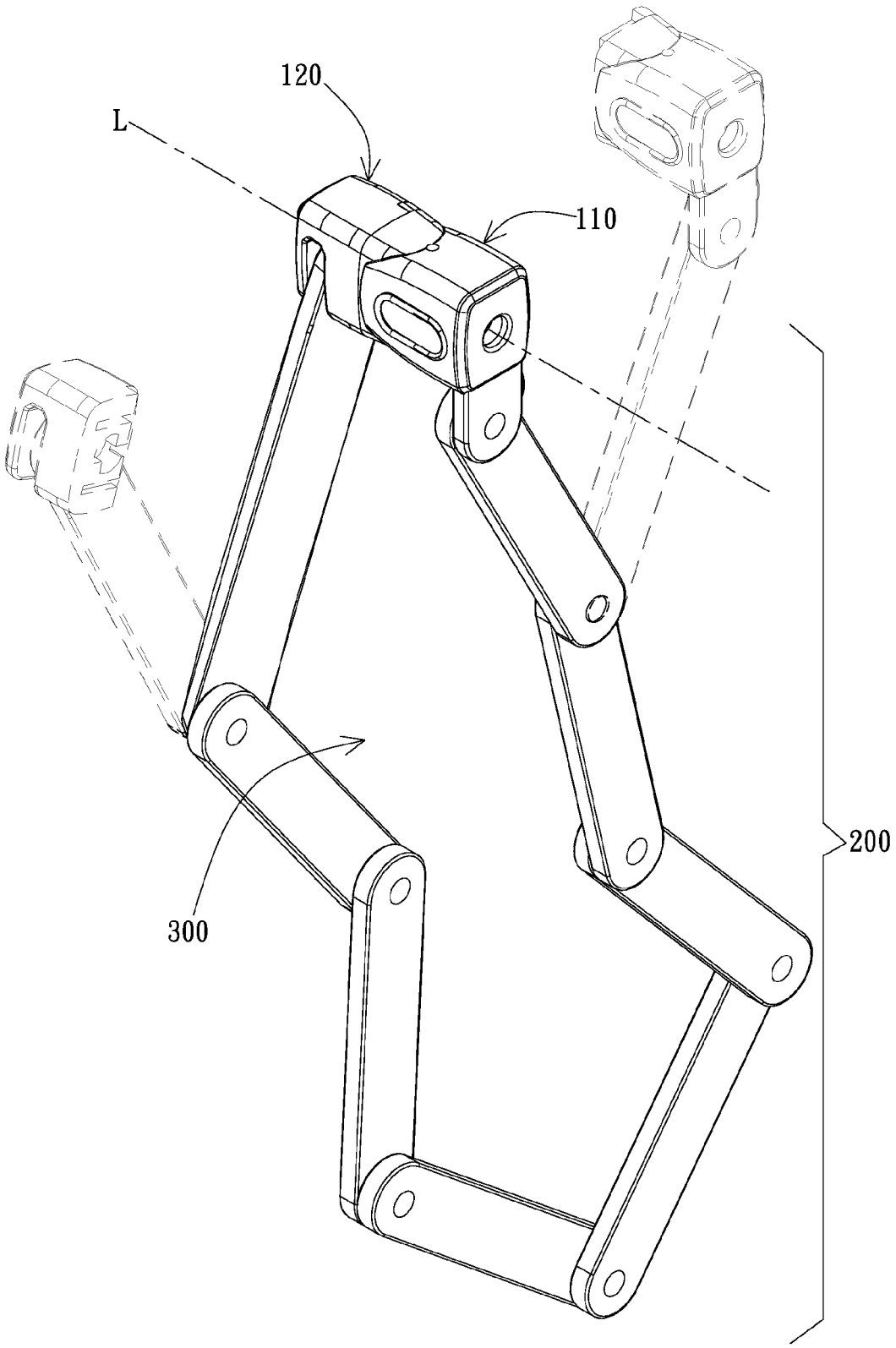
FIG. 6 is a schematic view of an operation of the bodies of the embodiment of the foldable lock.

When the first mating face 111 and the second mating face 121 match by means of guiding the guiding components, the first body and the second body also conjugates with each other at the same time. FIG. 6 shows the closed ring 300 composed of the conjugated first body 110 and second body 120, as well as the rod set 200. In order to form the closed ring 300, the first body 110 and the second body 120 has to move relatively to reach a position along a line, such as a line L, where the first mating face 111 and the second mating face 121 are complementary to and contact with each other, and a projection of the first mating face 111 is completely on the second mating face 121; and vice versa. For achieving the position and overlapping of the mating faces, the relative movement of the first body 110 and the second body 120, in the embodiment of the present invention, is that the second body 120 relatively move from the left side of the first mating face 111 of the first body 110 to the line L; and vice versa. Therefore, the guiding protrusion 135 of the first mating face 111 can come closer to the open end 123 of the second mating face 121. In other embodiments, the relative movement of bodies may be that the second body 120 relatively moves from the right side of the first mating face 111 of the first body 110 to the line L. When the bodies relatively moves to a degree that the partial first mating face 111 and the partial second mating face 121 start to contact each other, the guiding protrusion 135 will enter the guiding groove 122 through the open end 123 and therefore the rotatable fastener 133 will enter the containing trough 125.

Figure 7C:
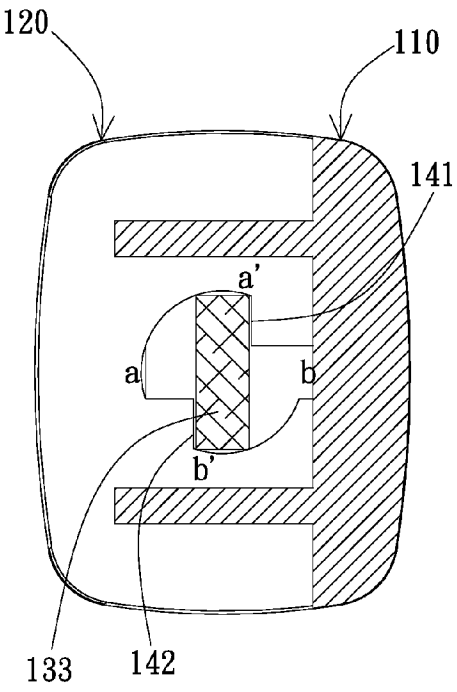
FIGS. 7A-7C are cross-sectional views of the mating faces of the bodies shown in FIG. 6 illustrating the operations of the rotatable fastener.
Figure 7B:
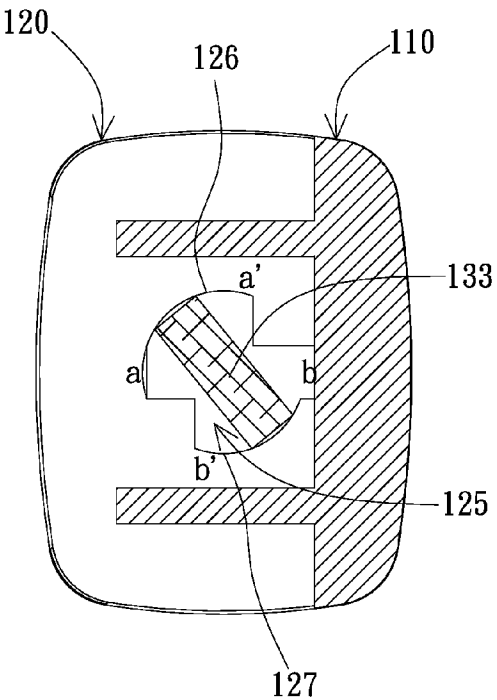
Figure 7A:
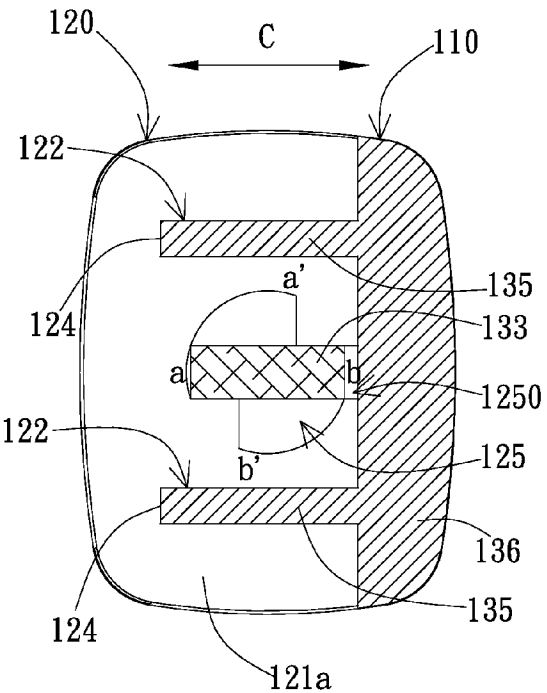

FIG. 7A shows a cross-sectional view of the mating faces of the conjugated bodies, wherein the second mating face 121*a* of the second body 120 contacts with the first mating face 111*a* (not shown in FIG. 7A). The matching of the first mating face 111*a* and the second mating face 121*a* starts when the first mating face 111*a* contacts with the second mating face 121*b*. A cross-sectional view of the guiding protrusion 135 and the blocking portion 136 are also shown in FIG. 7A, wherein the guiding protrusion 135 is completely within the complementary guiding groove 122. At this time, the top surface of the blocking portion 136 (belonging to the first mating face 111*b*) contacts with the second mating face 121*b*. In summary, the first mating face 111 and the second mating face 121 overlap. In addition, the conjugated bodies cannot move relatively at random. Only a movement C that the guiding protrusion 135 moves in a direction opposite to the direction in which the guiding portion 135 enter the guiding groove 122 is allowable.

In conclusion, after the bodies conjugate, the inserted key in the key hole will be able to rotate to drive the rotatable fastener 133 to rotate in the containing trough 125. As FIGS. 7B-7C show, it can be seen that the rotatable fastener 133 rotates clockwise. Namely, the end of the rotatable fastener 133 entering the containing trough 125 first will move from positions a to a' along a first arc portion 126 while the other end of the rotatable fastener 133 will move from the position b at the opening 1250 to the position b' along a second arc portion 127. In other words, the rotatable fastener 133 rotates 90 degrees. After the rotation, as FIG. 7C shows, the rotatable fastener 133 occupies the space having length equal to the distance between positions a' and b'. At least one stopping portion is further disposed in the containing trough 125 to limit rotation of the rotatable fastener 133. Particularly, the rotatable fastener 133 interferes with at least a stopping portion (which is a first stopping portion 141 and a second stopping portion 142), to stop rotating in an engaging state. Therefore the first body 110 and the second body 120 cannot have the movement C and thus the locking operation is achieved.

Figure 8:
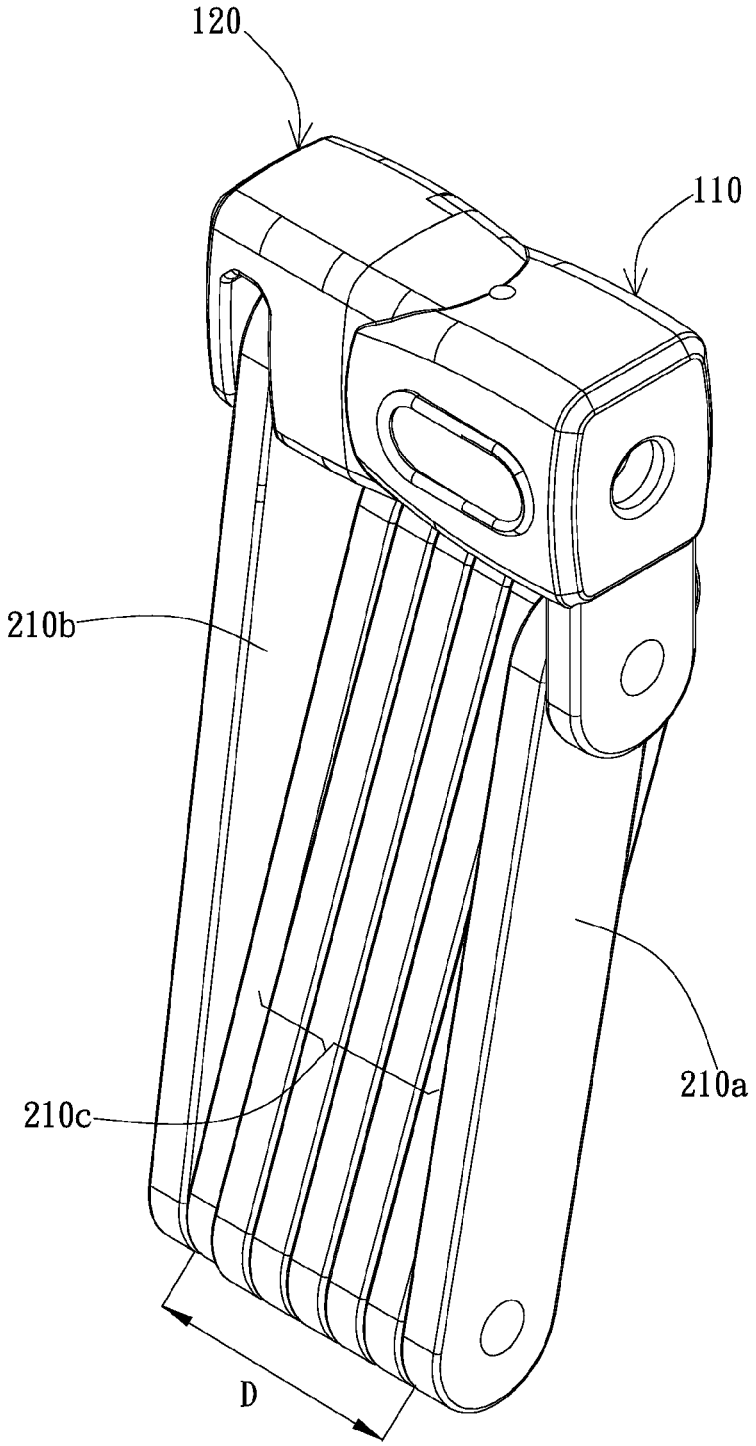
FIG. 8 is another perspective view of the embodiment of the foldable lock of the present invention.

FIG. 8 and FIG. 6 show the perspective views of the conjugated bodies. As FIG. 6 shows, when the foldable lock is utilized to secure an object, such as vehicle, the first mating face 111 of the first body 110 mates with the second mating face 121 of the second body 120 and the first body 110 is engaged with the second body 120 due to the operations of the lock boy as well as the rotatable fastener, so that the conjugated and locked first body 110 and second body 120 will not move relatively, and together with the rod set 200 is in the expanded state forming a closed ring 300 with the first body 110 and the second body 120 to secure the object. In addition, as FIG. 8 shows, when the foldable lock is not in use, the first locking rod 210*a* and the second locking rod 210*b* may be rotated to be parallel with each other to the stacking state, wherein the locking rods 210*a*, 210*b*, 210*c* form a block configuration together with the first body 110 and the second body 120. In the block configuration, the first locking rod 210*a* and the second locking rod 210*b* are apart from each other with the third locking rods 210*c* in between, wherein a perpendicular distance D exists between the first locking rod 210*a* and the second locking rod 210*b*. Since the locking rods are stacked on each other, the perpendicular distance D is only slightly greater than or substantially equal to a sum of the thickness of the six stacked third locking rods 210*c*. Therefore, the closed ring 300 can be adjusted to a stacking state, as FIG. 8 shows, for storage by rotating the locking rods 210.

Although the preferred embodiments of present invention have been described herein, the above description is merely illustrative. The preferred embodiments disclosed will not limited the scope of the present invention. Further modification of the invention herein disclosed will occur to those skilled in the respective arts and all such modifications are deemed to be within the scope of the invention as defined by the appended claims.

What is claimed is:

1. A foldable lock, comprising:

a first body, comprising a first mating face resting in a first plane and a rotatable fastener exposed from the first mating face;

a second body, comprising a second mating face resting in a second plane parallel to the first plane and a containing trough on the second mating face, the second mating face and the first mating face being moveable relative to each other in a direction parallel to the first and the second plane to separably mate with each other so that the rotatable fastener enters the containing trough and the second body separably conjugates with the first body, wherein the rotatable fastener selectively rotates in the containing trough; and a rod set, comprising a plurality of locking rods pivotally connected in series and connected to the first body and the second body at two ends of the rod set, wherein each locking rod is rotatable in two-dimension space with a connection joint as a rotation axis; the rotation axis is parallel to the normal line of the first mating face and the normal line of the second mating face;

wherein the locking rods are selectively rotated to a stacking state to form a block configuration with the first body and the second body and to an expanded state to form a closed ring with the first body and the second body.

2. The foldable lock of claim 1, wherein a protrusion portion is formed on the first mating face, a cavern portion is formed on the second mating face, and outlines of the protrusion portion and the cavern portion are complementary to each other.

3. The foldable lock of claim 2, wherein the protrusion portion includes at least one guiding protrusion and a blocking portion connected to the guiding portion, the cavern portion includes at least one guiding groove corresponding to the at least one guiding protrusion.

4. The foldable lock of claim 1, wherein at least one stopping portion is further disposed in the containing trough to limit rotation of the rotatable fastener.

5. The foldable lock of claim 4, wherein the first body includes a lock body, and the rotatable fastener is a part of the lock body and rotatably driven by the operation of the lock body.

6. The foldable lock of claim 5, wherein the lock body is a key lock, and a key hole is formed on the rear side of the first body opposite to the first mating face.

7. The foldable lock of claim 1, wherein the containing trough has an opening allowing the rotatable fastener to enter the containing trough as the first mating face mates with the second mating face.

8. The foldable lock of claim 7, wherein the containing trough has at least one arc portion, the rotatable fastener rotates along the arc portion.

9. The foldable lock of claim 1, wherein each locking rod has a first end and a second end, the plurality of the locking rods are pin-connected in series by the first end and the second end, and a pin joint serves as the connection joint of adjacent locking rods.

10. The foldable lock of claim 9, wherein the plurality of locking rods include a first locking rod and a second locking rod pivotally connected to the first body and the second body respectively.

11. The foldable lock of claim 10, wherein the plurality of locking rods include at least one third locking rod connected between the first locking rod and the second locking rod.

12. The foldable lock of claim 11, wherein as the locking rods are rotated to the stacking state, a perpendicular distance between the first locking rod and the second locking rod is slightly greater than or substantially equal to a sum of the thickness of the at least one third locking rod.

13. A foldable lock, comprising:

a first body, comprising a first mating face resting in a first plane, a rotatable fastener exposed from the first mating face, and a lock body; wherein the rotatable fastener is a part of the lock body and rotatably driven by the lock body;

a second body, comprising a second mating face resting in a second plane parallel to the first plane and a containing trough on the second mating face, wherein the containing trough has at least one arc portion; the second mating face and the first mating face being moveable relative to each other in a direction parallel to the first plane and the second plane to separably mate with each other so that the rotatable fastener enters the containing trough and the second body separably conjugates with the first body, wherein the rotatable fastener selectively rotates along the at least one arc portion in the containing trough; and a rod set, comprising a plurality of locking rods pivotally connected in series and connected to the first body and the second body at two ends of the rod set, wherein each locking rod is rotatable in two-dimension space with a connection joint as a rotation axis; the rotation axis is parallel to the normal line of the first mating face and the normal line of the second mating face;

wherein the locking rods are selectively rotated to a stacking state to form a block configuration with the first body and the second body and to an expanded state to form a closed ring with the first body and the second body.

* * * * *